US008360827B1

(12) United States Patent
Coughtry

(10) Patent No.: US 8,360,827 B1
(45) Date of Patent: Jan. 29, 2013

(54) ROAD MARKING REMOVAL SYSTEM AND METHOD

(76) Inventor: Richard J. Coughtry, Stuart, FL (US)

( * ) Notice: Subject to any disclaimer, the term of this patent is extended or adjusted under 35 U.S.C. 154(b) by 343 days.

(21) Appl. No.: 12/720,640

(22) Filed: Mar. 9, 2010

(51) Int. Cl.
*B24C 3/06* (2006.01)

(52) U.S. Cl. ..... 451/92; 451/82; 451/102

(58) Field of Classification Search ..... 451/92, 451/102, 87; 134/172; 15/321, 345, 346, 15/320, 340.1, 340.3
See application file for complete search history.

(56) References Cited

U.S. PATENT DOCUMENTS

| | | | | |
|---|---|---|---|---|
| 2,125,445 | A * | 8/1938 | Holveck | 239/599 |
| RE27,314 | E * | 3/1972 | Codina et al. | 451/92 |
| 3,770,204 | A * | 11/1973 | Schuster | 239/288.5 |
| 4,376,358 | A * | 3/1983 | Shelton | 451/92 |
| 4,845,801 | A * | 7/1989 | Milly et al. | 15/321 |
| 5,323,797 | A * | 6/1994 | Rankin | 134/167 C |
| 5,460,657 | A * | 10/1995 | Ally | 134/20 |
| 5,667,429 | A * | 9/1997 | Uchida et al. | 451/87 |
| 5,695,385 | A * | 12/1997 | Bachand et al. | 451/38 |
| 5,709,590 | A * | 1/1998 | McPhee et al. | 451/87 |
| 5,852,847 | A * | 12/1998 | Weiss et al. | 15/346 |
| 6,042,299 | A | 3/2000 | Cooper | |
| 6,193,589 | B1 * | 2/2001 | Khalaj | 451/102 |
| 6,254,462 | B1 * | 7/2001 | Kelton et al. | 451/87 |
| 6,381,801 | B1 * | 5/2002 | Clemons, Sr. | 15/320 |
| 6,464,569 | B1 * | 10/2002 | Thierer | 451/92 |
| 7,255,116 | B2 | 8/2007 | Crocker | |
| 7,426,769 | B2 * | 9/2008 | Mensch | 15/340.1 |
| 7,429,146 | B2 * | 9/2008 | Hall et al. | 404/93 |
| 7,442,112 | B2 * | 10/2008 | Yoon | 451/8 |
| 7,735,186 | B1 * | 6/2010 | Vogel | 15/320 |
| 8,051,529 | B2 * | 11/2011 | Shea | 15/320 |
| 2001/0051493 | A1 * | 12/2001 | Kelton et al. | 451/36 |
| 2003/0097727 | A1 * | 5/2003 | Keller | 15/345 |
| 2003/0102934 | A1 * | 6/2003 | Victor | 333/22 R |
| 2006/0000491 | A1 | 1/2006 | Crocker | |
| 2007/0113368 | A1 * | 5/2007 | Alexander | 15/321 |
| 2007/0169305 | A1 * | 7/2007 | Shea | 15/320 |
| 2007/0169797 | A1 | 7/2007 | Crocker | |
| 2008/0066781 | A1 | 3/2008 | Crocker | |
| 2008/0310917 | A1 * | 12/2008 | Hall et al. | 404/94 |
| 2009/0241999 | A1 | 10/2009 | Crocker | |
| 2011/0131752 | A1 * | 6/2011 | Place | 15/320 |

FOREIGN PATENT DOCUMENTS

JP 63196379 A * 8/1988

* cited by examiner

*Primary Examiner* — George Nguyen
(74) *Attorney, Agent, or Firm* — Gold & Rizvi, P.A.; Glenn E. Gold; H. John Rizvi

(57) ABSTRACT

A road marking removal system creating a blasting mixture by injecting particulate matter from a media hopper into flowing compressed air. The blasting mixture is directed at a road marking via a blasting nozzle. The nozzle discharges the blasting mixture from within a marking removal head housing. A vacuum is applied to an interior of the marking removal head housing for collecting the residual material created by the removal process. The residual material consists of particulate matter, road marking debris, and the like. The collected material can optionally be sorted with material of an acceptable size being reclaimed and forwarded to the media hopper for reuse. The road marking removal system can be manually operated being integrated into a cart, or remotely operated when integrated into a vehicle.

19 Claims, 11 Drawing Sheets

ROAD MARKING REMOVAL SYSTEM AND METHOD

FIELD OF THE INVENTION

The present disclosure generally relates to an apparatus and method for removing road markings. More particularly, the present disclosure relates to a road marking removal system which propels a solid media in either dry or slurry format towards a road marking to abrade and remove the marking, while in parallel, collecting the residue via a vacuum system

BACKGROUND OF THE INVENTION

The purpose of the present invention is to provide an apparatus and method for removal of road markings.

Road surface markings are used on paved roadways to provide guidance and information to drivers and pedestrians. Uniformity of the markings is an important factor in minimizing confusion and uncertainty about their meaning. Road markings can identify lanes, direction of traffic flow, turning guidance, speed limits, school zones, and the like. Road markings are applied with a material that is capable of continuous, harsh conditions, including weather, vehicular traffic, debris, and other abrasive conditions.

Road markings are applied using a variety of materials, including paint, thermoplastic, plastic, epoxy, and the like. Additives such as reflective glass beads are mixed into the material to aid the driver.

The road markings are applied using materials designed to withstand abrasion from traffic, weather, and the like. Contrarily, there are scenarios where traffic control groups desire to remove the road markings.

Several inventors have disclosed road marking removal systems. Each of these utilises ultra high pressure water jet technology. Water jet technology requires a significant amount of energy to pressurize, accelerate and blast the water towards the road marking. The equipment required for the water jet technology is bulky and expensive. The use of water introduces the potential for corrosion as well as high maintenance.

A second process utilizes mechanical abrading or grinding. Contact removal is generally slow and creates a large mess. The debris is spewed about as a result of the rotational grinding process, directing a second cleanup process. The system can damage the road if the operator is not careful.

What is desired is a road marking removal system that is effective and also environmentally friendly. The system should be capable of operation with only a minimal impact to traffic. The preferred system would also be capable of for use in small, precision jobs.

SUMMARY OF THE INVENTION

The present invention provides a system, which blasts media through a marking removal head assembly. The removal head assembly utilizes a housing for controlling the media disbursement, then provides a collection nozzle for retrieving the residual material via a vacuum system.

A first aspect of the present invention provides a road marking removal system comprising:

a marking removal head housing having a media inlet port in fluid communication with a blasting nozzle and a vacuum particle retrieval port for extracting residual particles;

an air compression unit;

a solid media hopper for injecting solid media into a media delivery conduit, the media conduit providing fluid communication between the air compressor unit and the media inlet port;

a vacuum unit; and a vacuum conduit providing fluid communication between the vacuum particle retrieval port and the vacuum unit.

A second aspect of the present invention is an inclusion of a residue collection container in communication with the vacuum unit.

In yet another aspect, is an inclusion of a filtration system within the vacuum assembly, wherein the filtration system returns particles of a desired size to the solid media hopper.

While in another aspect, the blasting nozzle accelerates the blast media mixture towards the road marking. In one embodiment, the acceleration of the media is accomplished by reducing the diameter of the nozzle passageway along the flow path of the media.

And in another aspect, the road marking removal system is integrated onto a road marking removal vehicle.

In another aspect, the road marking removal head is operably mounted to a road marking removal frame.

While in another aspect, the road marking removal frame includes an articulating arm.

In yet another aspect, the road marking removal frame comprises at least one generally horizontally configured slide rail member.

While in another aspect, the marking removal head is mounted to a road marking removal arm, the arm having a frame mount disposed at the assembly end of the arm. The frame mount is slideably assembled to the slide rail member.

In yet another aspect, the road marking removal head can be removably attached to the road marking removal arm, allowing installation of the removal head onto a manually operated removal cart assembly. It is recognized the cart assembly can further comprise an auxiliary motor or other drive mechanism.

A method aspect of the present invention provides method of removal of road markings the method comprising the steps of:

providing compressed air;

combining particulate matter with flowing compressed air forming a blasting mixture;

transferring the blasting mixture to a road marking removal head, the head comprising a blasting nozzle;

passing the blasting mixture through the blasting nozzle, directing the blasting mixture towards a road marking;

applying a vacuum suction to the road marking removal head;

collecting the residual material via the vacuum; and depositing the collected residual material in a residue collection container.

In yet another aspect, the method further comprising a steps of filtering the collected residual material and returning residual material of a predetermined size to the solid media hopper.

In yet another aspect, the method further comprising the steps of aligning the road marking removal head with a roadway marking via an operable mounting configuration.

In yet another aspect, the mounting configuration provides an articulating movement.

In yet another aspect, the mounting configuration provides a slideable motion sliding transverse to the vehicle. The mounting configuration further provides a height control by a pivotal assembly of the removal arm.

In yet another aspect, the method further comprising the steps of aligning the road marking removal head with a roadway marking via a manual operation, whereby the road marking removal head is assembled to a manually operated removal cart assembly. An auxiliary drive system can provide power assistance to the manually operated cart assembly.

These and other aspects of the present invention are best understood as described in the detailed description and respective figures presented herein.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 2:
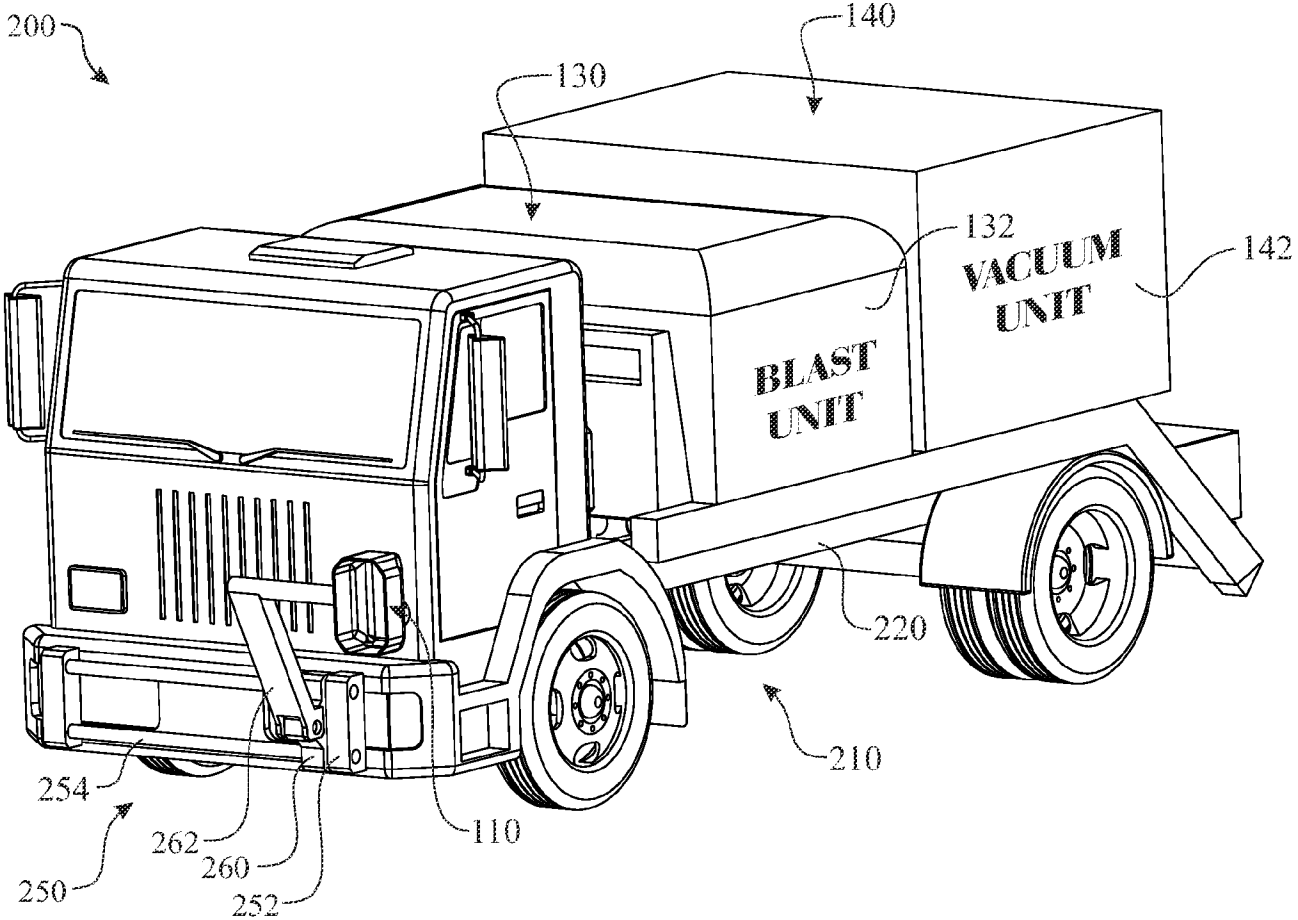
FIG. 2 presents an isometric view of an exemplary road marking removal system as defined in FIG. 1, the removal system being integrated into a road marking removal vehicle, the road marking removal head being shown in a stored configuration.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 2. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
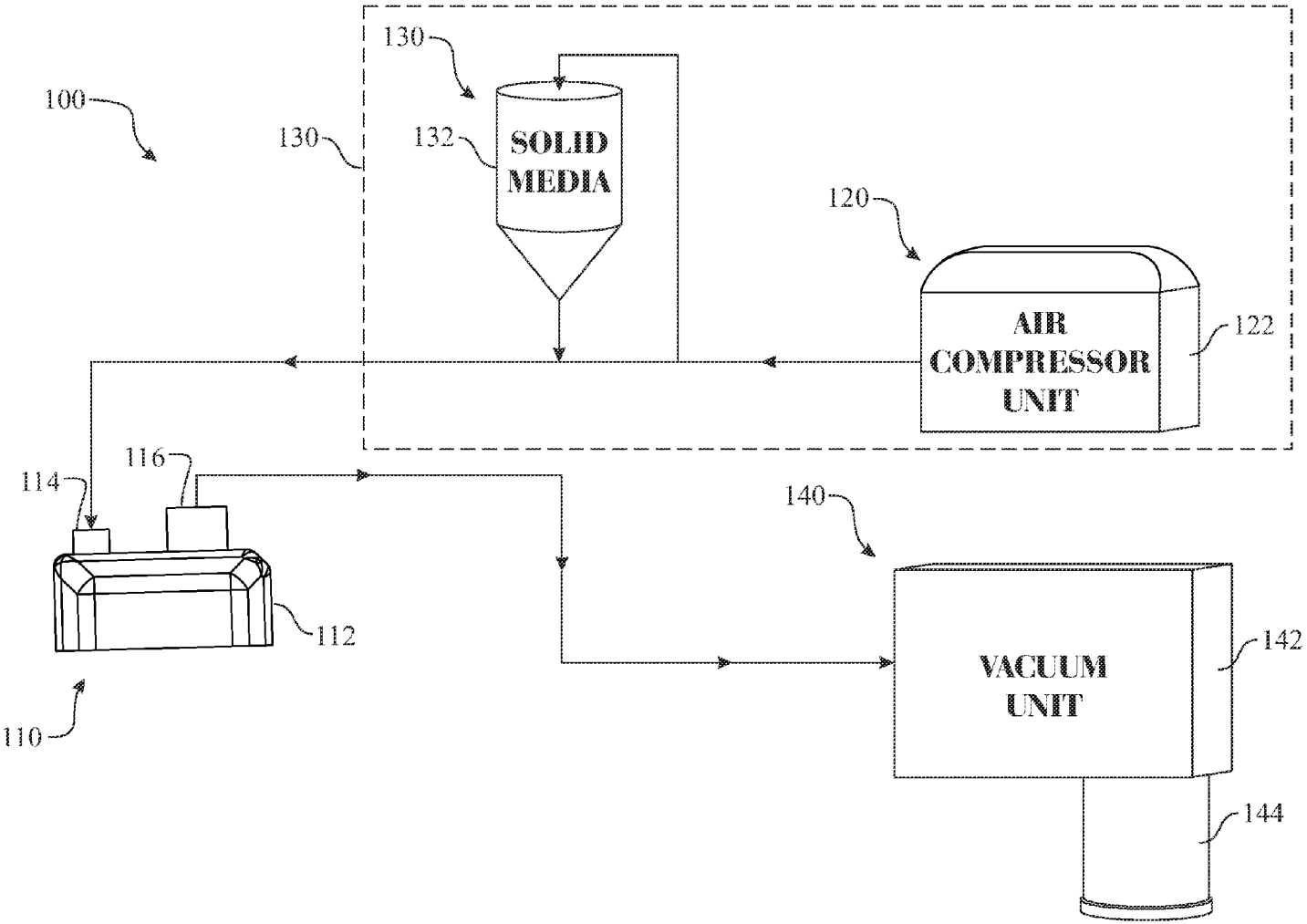
FIG. 1 presents an exemplary block diagram illustrating the general components and flow of a road marking removal system.

Under certain circumstances, traffic management organizations need to alter road markings. The present invention provides an apparatus and method for removing road markings, referred to as a road marking removal system 100, which is initially represented in the exemplary block diagram of FIG. 1. The road marking removal system 100 comprises an air compressor assembly 120, which provides compressed air into the system. The air compressor assembly 120 includes an air compressor 122 which can be of any form factor and reasonable power to provide continuous air pressure as needed for removal of the road markings. The air compressor assembly 120 can additionally include an air pressure tank (not shown, but well understood), which provides a reservoir ensuring continuous flow of pressurized air. A media hopper assembly 130 introduces particulate matter into the flow of compressed air forming a blasting mixture. The particulate matter can include any of the following: sand, aluminum oxide, black beauty, steel grit, soda-bicarbonate, abrasive sponge, and the like. The media hopper assembly 130 includes a media hopper 132. The media hopper 132 stores and feeds particulate matter into the airflow generated by the air compressor 122. The blasting mixture is transferred to a marking removal head assembly 110 and discharged, being directed towards the road marking via a nozzle (170 of FIG. 8 or 180 of FIG. 9). A vacuum assembly 140 provides a vacuum to collect residue. The marking removal head assembly 110 includes a marking removal head housing 112, which creates a micro removal working environment. The created micro removal working environment aids the vacuum force in collection of the residual material. Fluid communication is provided between each of the individual components via a series of conduits represented by flow arrows in the block diagram.

The road marking removal system 100 can be integrated into any of a variety of support apparatus. A first exemplary apparatus is a road marking removal vehicle 200, wherein the road marking removal system 100 is integrated onto a donor truck 210, as illustrated in FIGS. 2 through 7. The donor truck 210 comprises the general components of a vehicle, including a truck frame 220. The donor vehicle is preferably arranged such to expose an upper section of the truck frame 220 in a manner conducive for mounting the vacuum assembly 140 and media hopper assembly 130 thereon. The marking removal head assembly 110 can be operably integrated to the donor truck 210 via a road marking removal mounting frame 250. The exemplary embodiment of the road marking removal mounting frame 250 is assembled to a front end of the donor truck 210. This provides the driver with an optimal view of the marking removal head assembly 110 during use. The road marking removal mounting frame 250 is configured having a mounting frame slide rail 254 span between a pair of mounting frame end members 252. The illustration presents a pair of round, tubular members being used for the mounting frame slide rail 254. It is understood that any beam having a continuous cross sectional shape can be used for the mounting frame slide rail 254, including an "I" beam, "C" channel, and the like. It is understood that although a slide configuration is presented as an exemplary embodiment, there are many other well-known assemblies providing mechanical movement. Any configuration providing movement in a plurality of directions to register the marking removal head assembly 110 to the road marking can be utilized.

Figure 3:
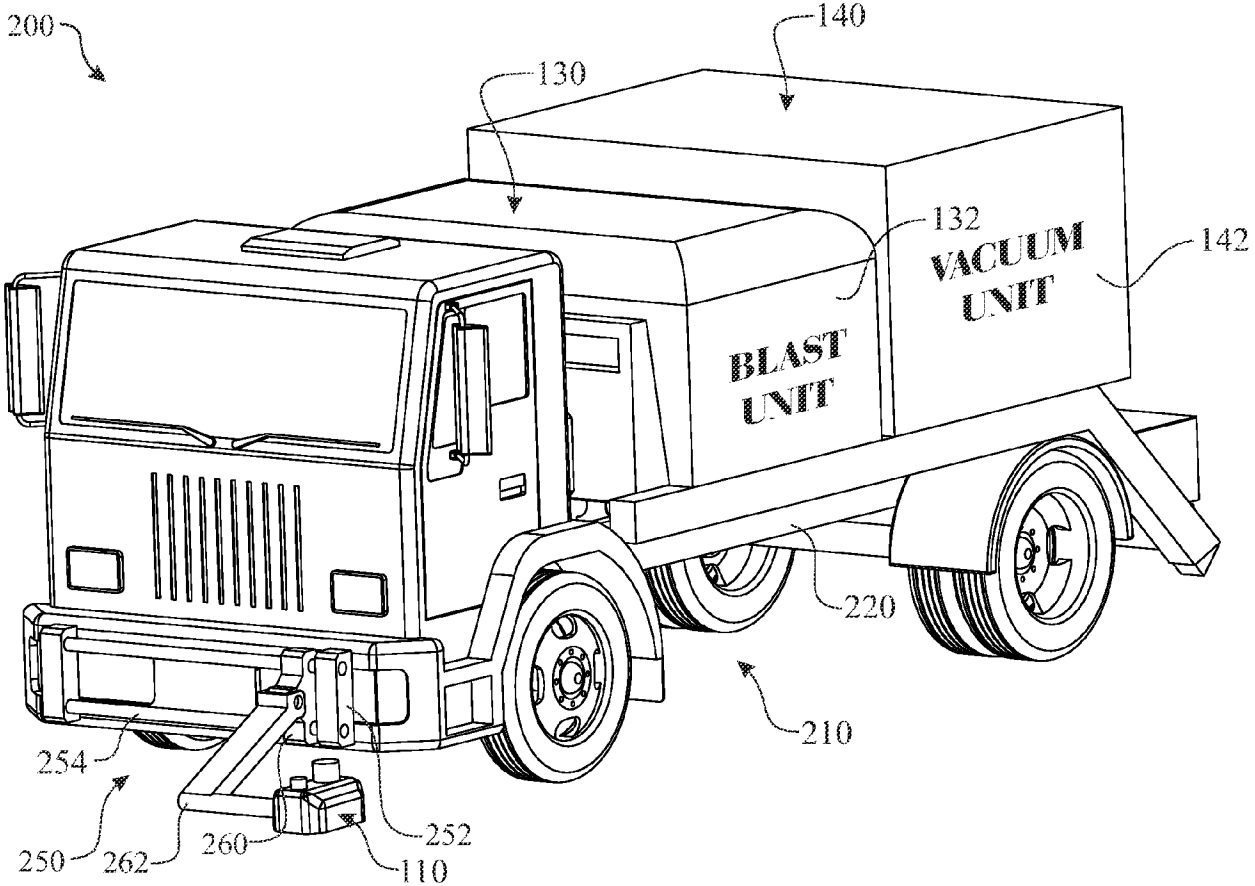
FIG. 3 presents an isometric view of the road marking removal vehicle of FIG. 2, the road marking removal head being shown in a first in use position.
Figure 4:
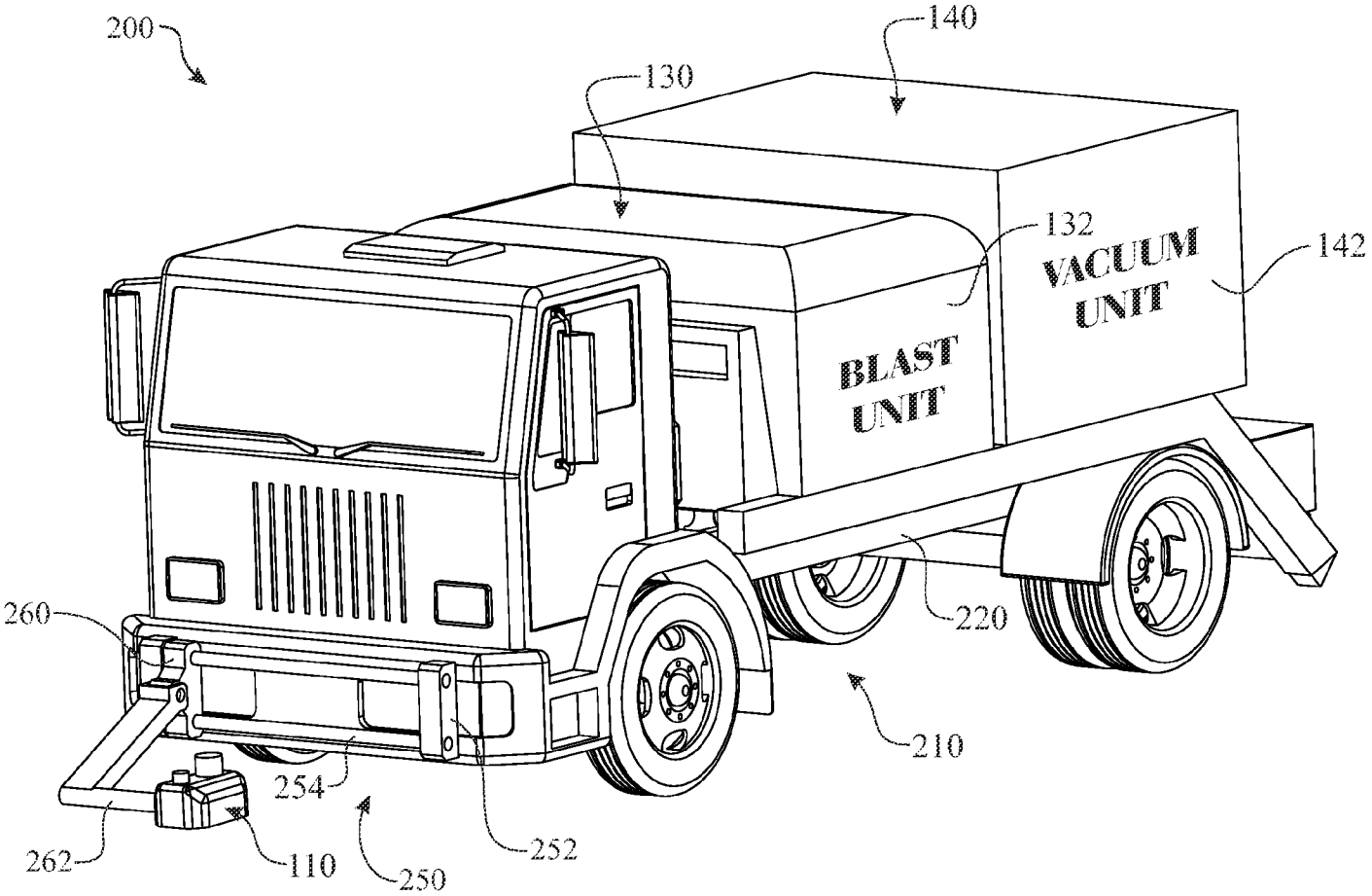
FIG. 4 presents an isometric view of the road marking removal vehicle of FIG. 2, the road marking removal head being shown in a second in use position.
Figure 5:
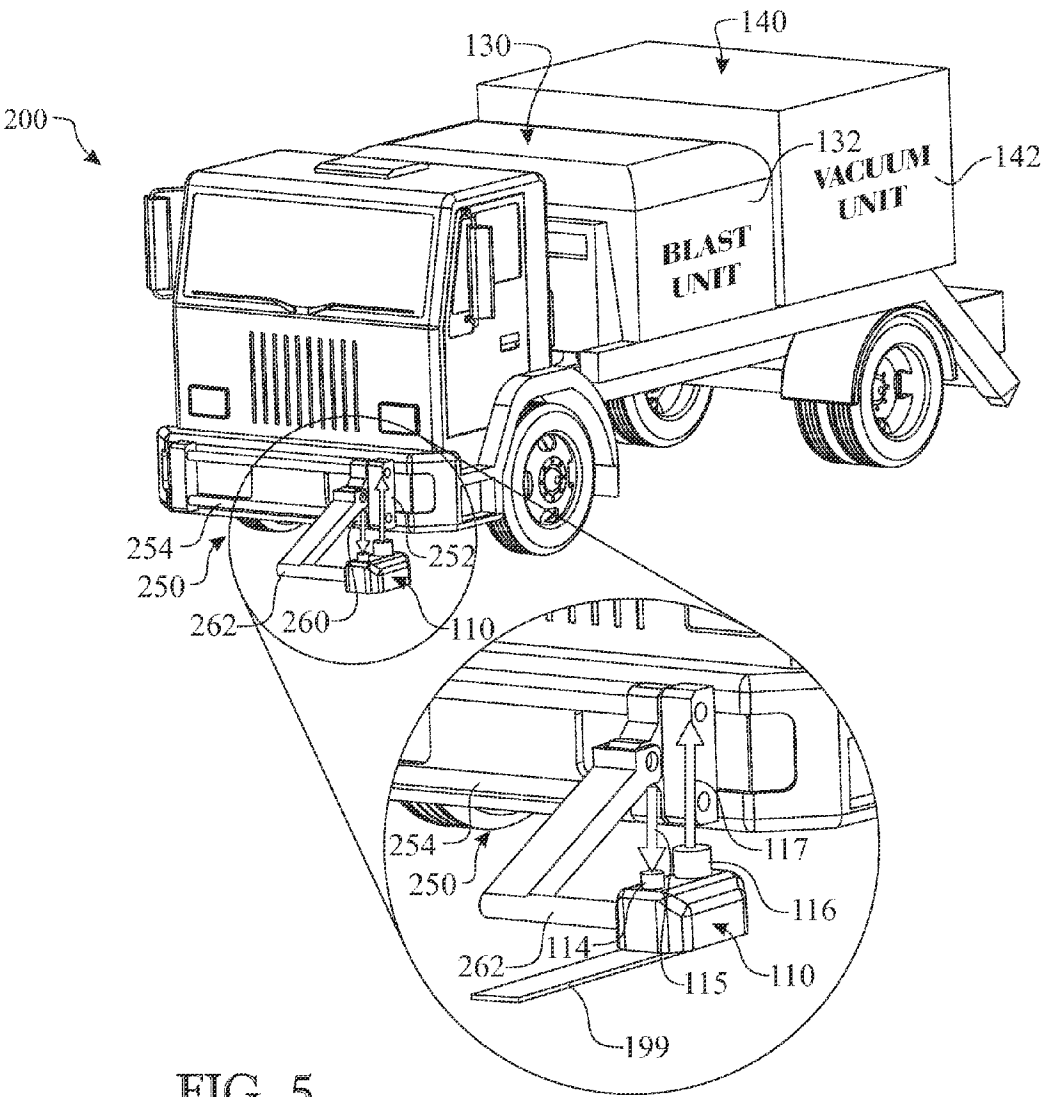
FIG. 5 presents an isometric view of the road marking removal vehicle of FIG. 2 detailing the operation of the road marking removal head.
Figure 6:
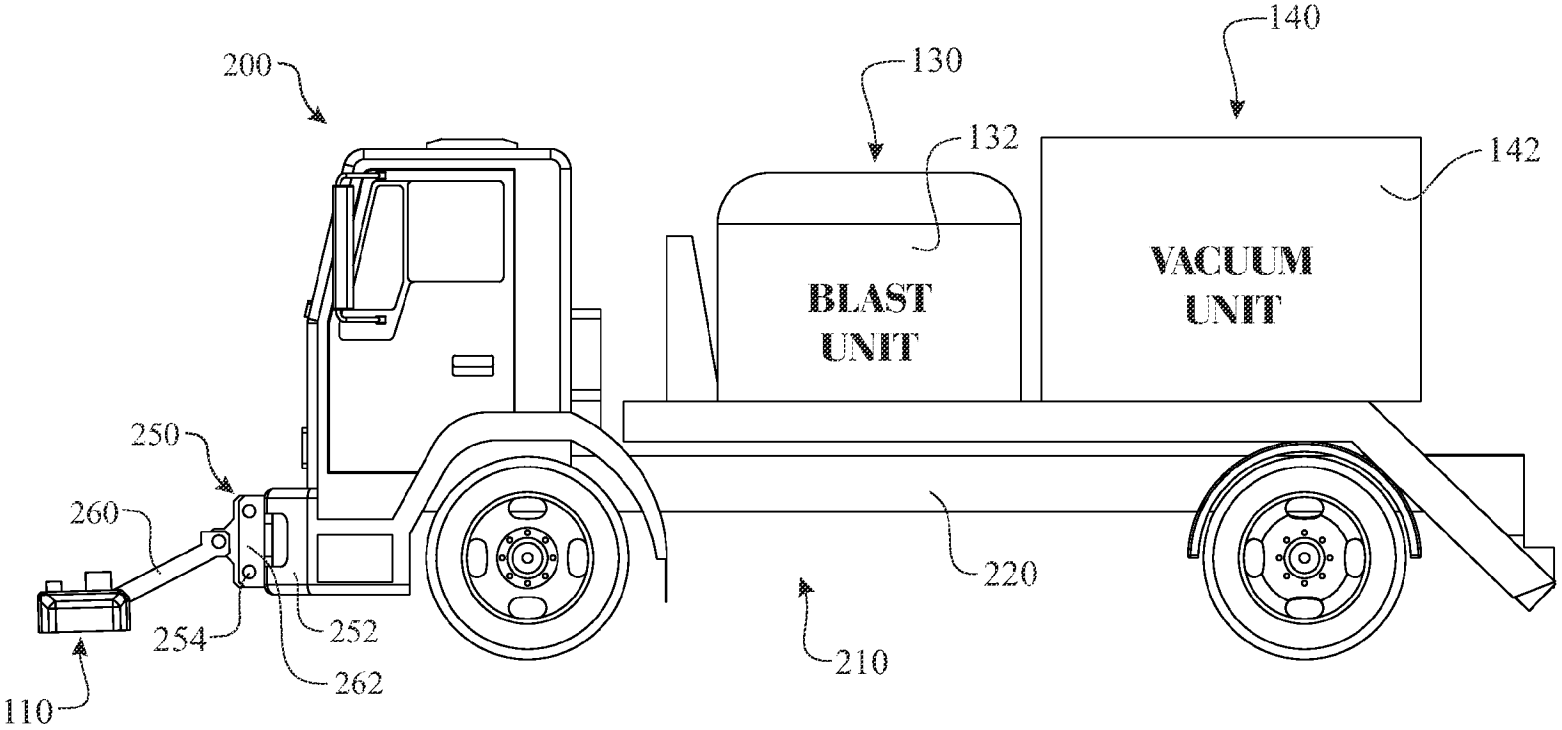
FIG. 6 presents a side elevation view of the road marking removal vehicle of FIG. 2.
Figure 7:
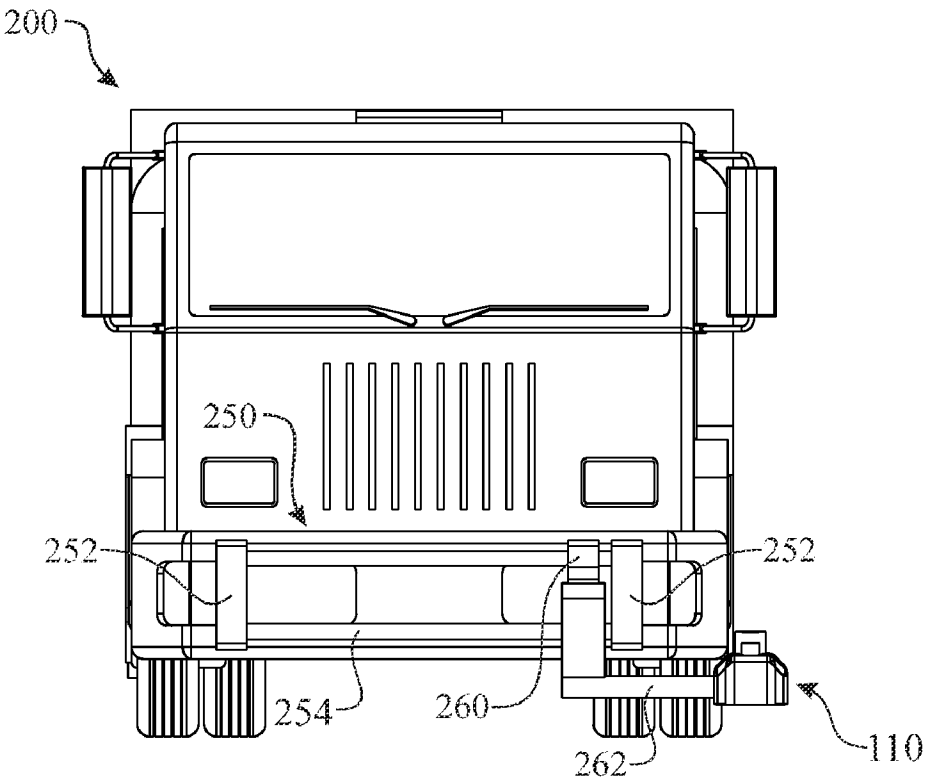
FIG. 7 presents a front elevation view of the road marking removal vehicle of FIG. 2.

The marking removal head assembly 110 is assembled to an extended end of a road marking removal pivotal arm 262. A road marking removal frame mount 260 is assembled to a proximate end of the road marking removal pivotal arm 262. The road marking removal frame mount 260 is slideably assembled to the mounting frame slide rail 254. A slide bearing can be provided between the road marking removal frame mount 260 and the mounting frame slide rail 254 to aid in the sliding motion. The road marking removal frame mount 260 is slideably positioned along the mounting frame slide rail 254 as illustrated in FIGS. 3 and 4. Any form of motion controlling device can be integrated into the assembly to position the road marking removal frame mount 260 across the mounting frame slide rail 254. This can include motors, a hydraulic actuator, a pneumatic actuator, a cable drive, and the like. The road marking removal pivotal arm 262 is pivotally assembled to the road marking removal frame mount 260, whereby the road marking removal pivotal arm 262 rotates, positioning the marking removal head assembly 110 between a stored configuration (FIG. 2) and an in use configuration (FIG. 3). The road marking removal pivotal arm 262 can include additional motions to optimally position the marking removal head assembly 110 respective to the roadway and respective road marking 199 as illustrated in FIG. 5. Blasting mixture 115 is thrust through the removal media inlet port 114 of the marking removal head assembly 110 towards the road marking 199. The blast mixture 115 abrades the road marking 199, removing the road marking 199 from the roadway. The marking removal head assembly 110 includes a marking removal head housing 112, which can optionally comprise a skirt or other peripheral seal to optimize a vacuum force provided by the vacuum 142. The vacuum force generates a residue collection vacuum 117, which removes the residual material entrapped within the interior of the marking removal head assembly 110 through the vacuum particle retrieval port 116. It is noted that the vacuum particle retrieval port 116 be oriented rearward of the removal media inlet port 114. The residual material is collected and stored within the residue collection container 144. The residue collection container 144 is then emptied via any reasonable process.

Figure 8:
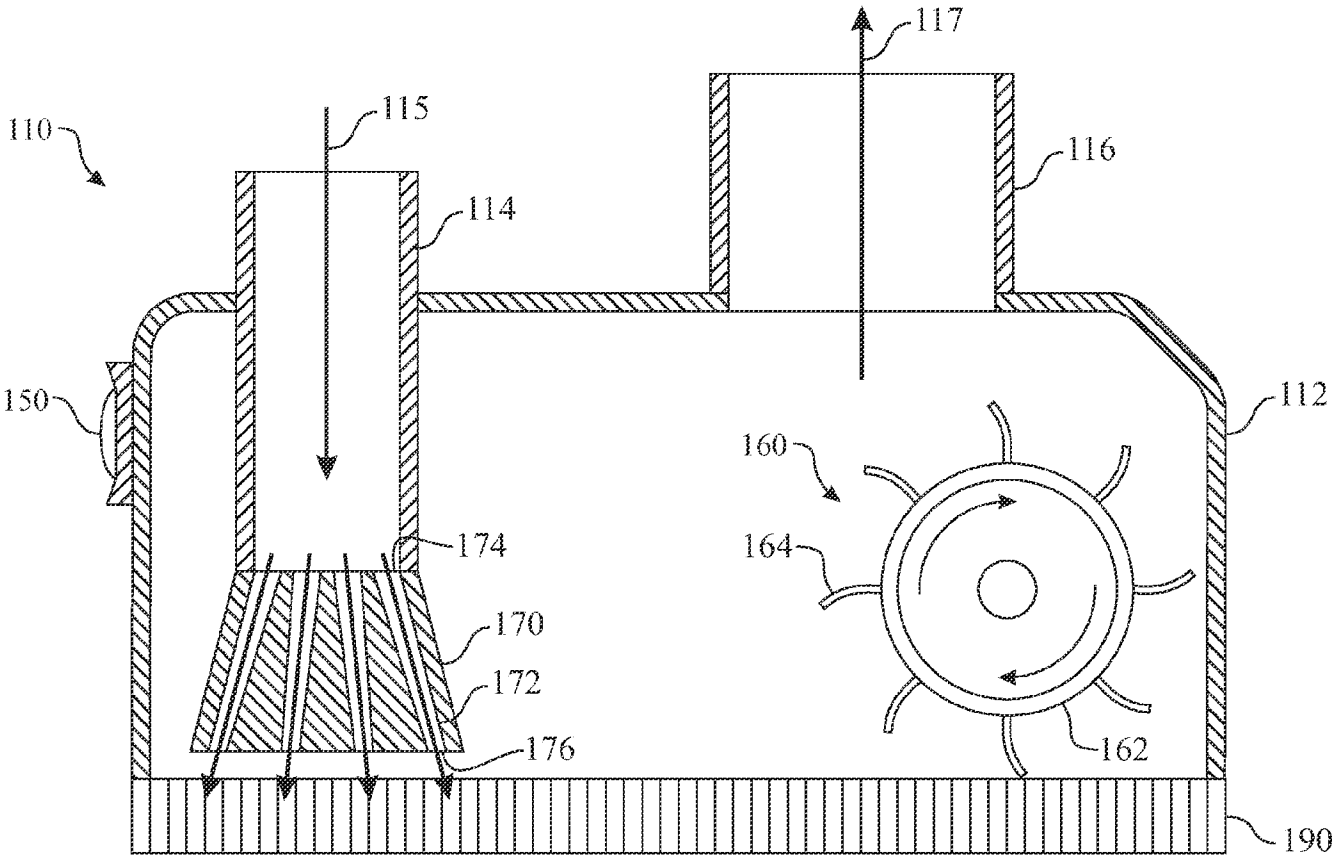
FIG. 8 presents a sectioned view of a first exemplary road marking removal head, detailing a blasting nozzle and a vacuum assist sweeper assembly.
Figure 9:
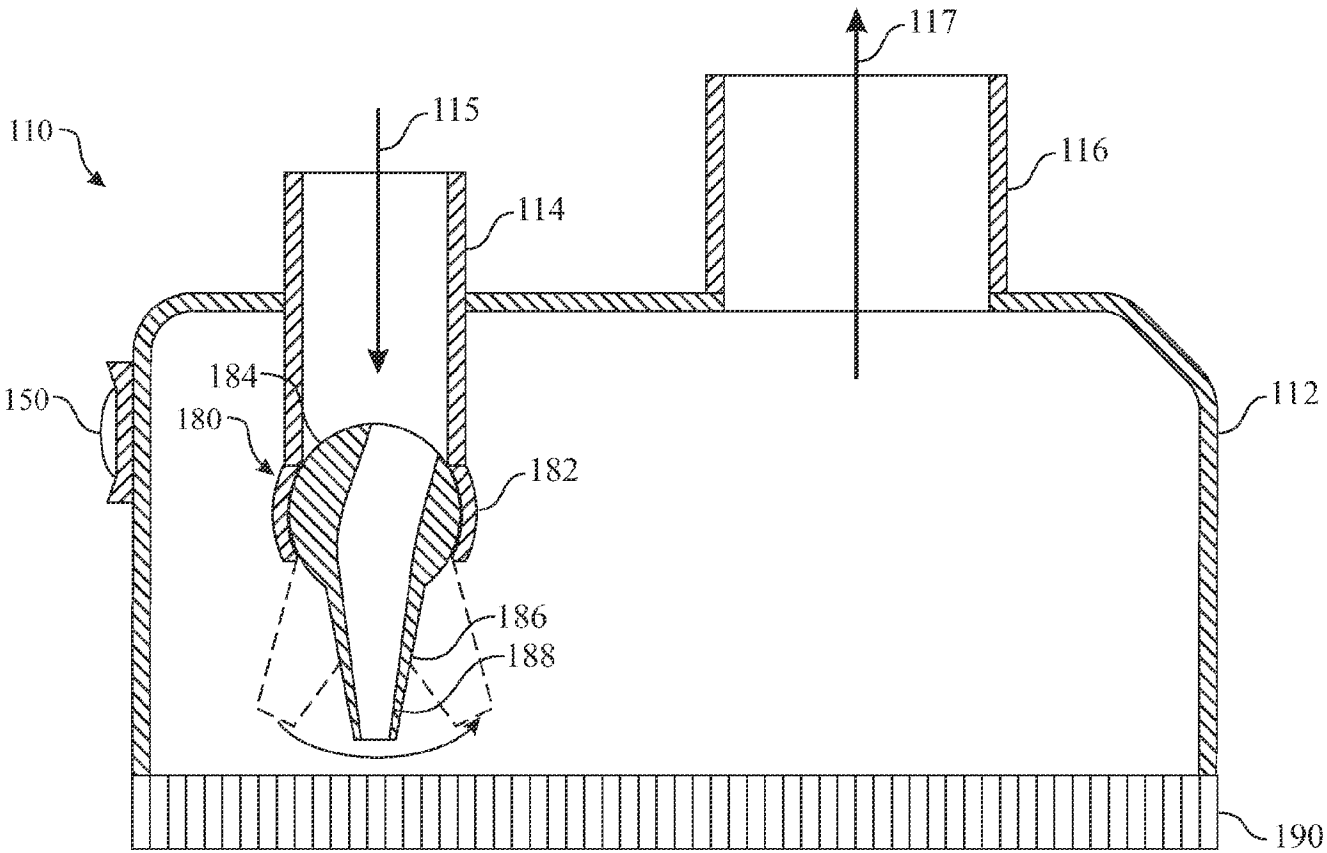
FIG. 9 presents a sectioned view of a second exemplary road marking removal head, detailing an articulating blasting nozzle.

The marking removal head assembly 110 can be configured with a variety of nozzle configurations, with two exemplary embodiments being presented in FIGS. 8 and 9. The blasting nozzle can be any off the shelf nozzle, or a custom configuration. A fixed direction blasting nozzle 170 is illustrated in FIG. 8. The blast mixture 115 enters through the removal media inlet port 114 and flows towards the blasting nozzle 170. The blasting nozzle 170 is configured with at least one nozzle port 172 having a nozzle inlet orifice 174 at an entrance end of the nozzle port 172 and a nozzle discharge orifice 176 at the discharge end of the nozzle inlet orifice 174. The diameter of the nozzle inlet orifice 174 is greater than the diameter of the nozzle discharge orifice 176 causing the passing blast mixture 115 to accelerate. Where a plurality of nozzle ports 172 are utilised, the nozzle discharge orifice 176 may be arranged in fanning pattern as illustrated. Alternately, the nozzle discharge orifice 176 can be directed inward for a more focused pattern. A sweeper assembly 160 can be optionally integrated into the marking removal head assembly 110. The exemplary sweeper assembly 160 includes a series of sweeper brushes 164 extending outward from a periphery of a sweeper roller 162. The sweeper roller 162 is rotationally assembled to the marking removal head housing 112. The sweeper assembly 160 can be rotationally driven via a motor, the residue collection vacuum 117, and the like. The series of sweeper brushes 164 aid in mechanically collecting residual matter from within the interior of the marking removal head housing 112 and directing the residual matter towards the vacuum particle retrieval port 116. A sealing skirt 190 can be assembled about a peripheral lower edge of the marking removal head housing 112. The sealing skirt 190 can be of any conforming form factor, such as fringe, plastic or rubber sheeting, and the like. The lower edges of the sealing skirt 190 can be weighted if needed to ensure the material remains substantially vertically. The marking removal head assembly 110 can be pivotally assembled to the road marking removal pivotal arm 262 allowing the marking removal head assembly 110 to follow the contour of the road surface. Wheels (not shown, but well understood) can be assembled to the lower region of the marking removal head housing 112, wherein the wheels contact the road surface. The marking removal head assembly 110 can be biased (such as via a spring or shock absorber) such to ensure the marking removal head assembly 110 follows the contour of the road surface. A camera 150 can be provided, such as being mounted onto the marking removal head housing 112, to aid the operator in setting and maintaining proper registration between the marking removal head housing 112 and the road marking 199.

An articulating nozzle assembly 180 is illustrated in FIG. 9. The articulating nozzle assembly 180 utilizes a ball joint interface allowing an articulating nozzle 186 to move in a spherical coordinate arrangement. The articulating nozzle 186 includes a nozzle port 188 provide therethrough and a ball joint 184 formed at a connecting end thereof. The ball joint 184 is assembled within a ball joint socket 182, providing the spherical motion. The nozzle port 188 includes a bend, wherein the passing airflow causes the articulating nozzle 186 to continuously reposition as illustrated in dashed lines. The articulating motion directs the focused blasting mixture 115 about a larger area. It is noted that the diameter of the inlet portion of the nozzle port 188 is larger than the diameter of the discharge portion of the nozzle port 188, thus accelerating the blast mixture 115.

Figure 10:
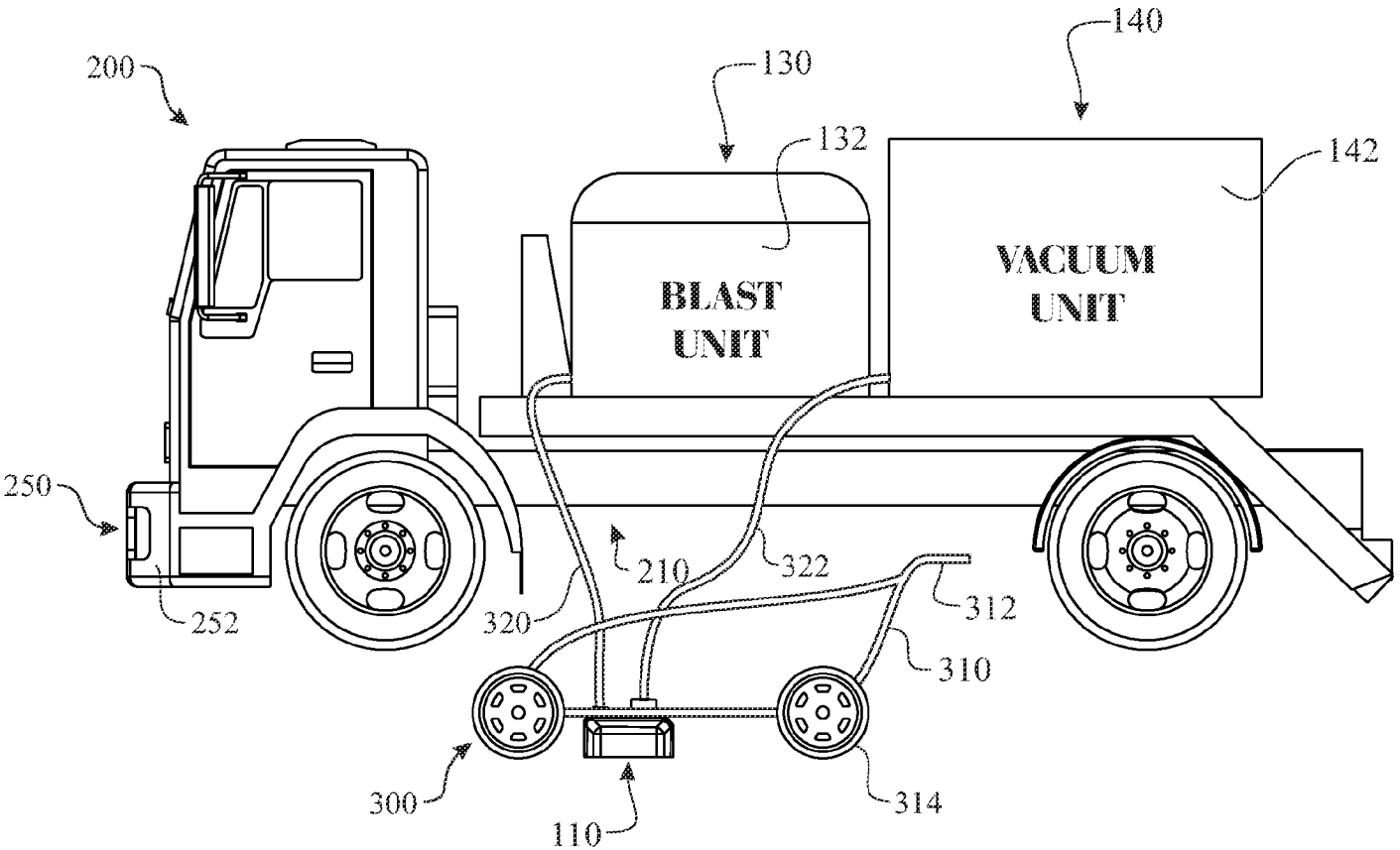
FIG. 10 an isometric view of the road marking removal vehicle of FIG. 2, introducing a manually operated removal cart assembly.

An expanded exemplary embodiment introduces a manually operated removal cart assembly 300, as illustrated in FIG. 10. The marking removal head assembly 110 is assembled to the manually operated removal cart assembly 300, allowing for a manual operation of the road marking removal system 100. The exemplary manually operated removal cart assembly 300 comprises a cart frame 310 having a plurality of cart wheel 314 for portability and a cart handle 312 for operable control by the worker. The cart frame 310 can be of any reasonable material, shape, and the like. The marking removal head assembly 110 is connected to the media blast assembly 150 and vacuum assembly 140 via a blast delivery conduit 320 and a residue collection conduit 322 respectively. The operator would remove the marking removal head assembly 110 from the road marking removal pivotal arm 262 and fastened to the cart frame 310. The operator then attaches the blast delivery conduit 320 and residue collection conduit 322 to the respective couplers. The operator then initiates operation of the road marking removal system 100 and directs the manually operated removal cart assembly 300 to align the marking removal head assembly 110 over the road marking. Operational controls can be attached proximate the cart handle 312 providing the user with easy, quick and direct access to system controls. An auxiliary power drive system can be integrated to aid the user in moving the manually operated removal cart assembly 300.

Although the manually operated removal cart assembly 300 is presented as a manually propelled and directed cart, the concept can be equated to a separation of the road marking removal system 100 into two portions. A first portion can be placed onto a large transporting vehicle, wherein the first portion preferably comprises the air compressor assembly 120, the media hopper assembly 130, and the respective conduits. A second portion can be placed into the manually operated removal cart assembly 300, wherein the second portion preferably comprises the marking removal head assembly 110. The separation provides the user with a smaller and more manageable vehicle for aligning the marking removal head assembly 110 with the road marking 199. The smaller vehicle can be the manually operated removal cart assembly 300, a tractor, a golf cart, a lawn mower like vehicle, and the like.

Figure 11:
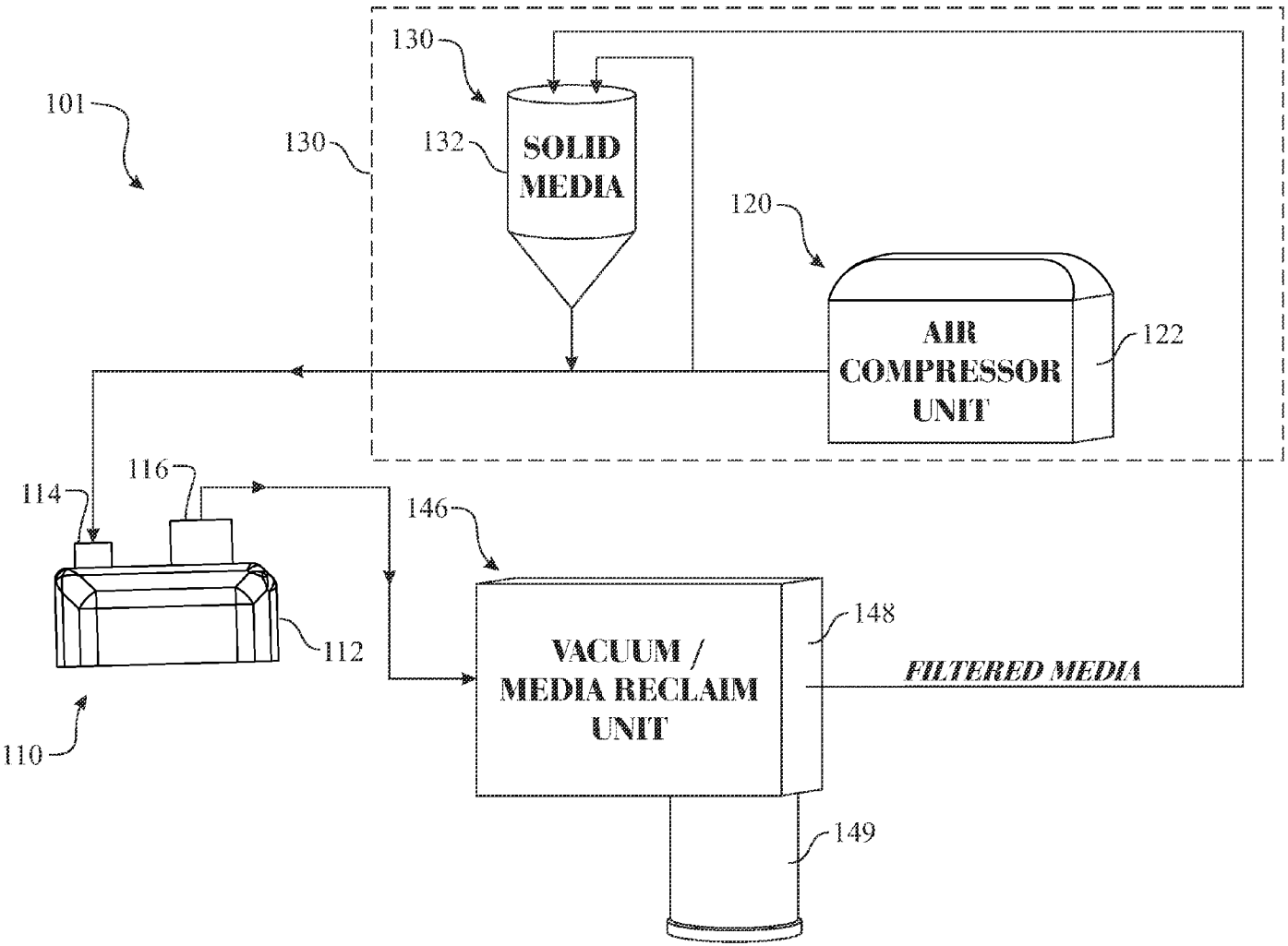
FIG. 11 presents an alternate exemplary block diagram illustrating the general components and flow of a road marking removal system incorporating a recycling subsystem.

An enhanced system is referenced as a recycling road marking removal system 101, being illustrated in FIG. 11. The recycling road marking removal system 101 introduces a media reclamation assembly 146 providing the ability of reusing the particulate matter. The media reclamation assembly 146 includes a vacuum system as well as a filtration or separation system integrated into a media reclamation vacuum and filter 148. The system collects the residual material from the marking removal head assembly 110, separates the collected material into a reusable size and a non-reusable size. The reusable material is then returned to the media hopper 132. The non-reusable material is collected in a non-reclaimed media collection container 149.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A road marking removal system comprising:

a carrier vehicle comprising a frame and a plurality of wheels;

a marking removal head housing having a media inlet port in fluid communication with a blasting nozzle and a vacuum particle retrieval port for extracting residual particles, the marking removal head housing being operably mounted to the carrier vehicle via at least one repositionable member, the operable mounting further comprising a slide interface rail horizontally configured and transversely mounted to a leading portion of the vehicle;

an air compression unit mounted to the carrier vehicle;

a solid media hopper for injecting solid media into a media delivery conduit, the media conduit providing fluid communication between the air compressor unit and the media inlet port, the solid media hopper being mounted to the carrier vehicle;

a vacuum unit mounted to the carrier vehicle; and a vacuum conduit providing fluid communication between the vacuum particle retrieval port and the vacuum unit.

2. A road marking removal system as recited in claim 1, the marking removal head housing being shaped having an interior working area formed by a peripheral sidewall being contiguous and extending downward from a top portion.

3. A road marking removal system as recited in claim 2, the arrangement further define having the blasting nozzle located on a leading region of the marking removal head housing and having the vacuum particle retrieval port located on a trailing region of the marking removal head housing.

4. A road marking removal system as recited in claim 2, further comprising a sweeper assembly mounted within a working interior, wherein the sweeper assembly aids in transferring residual material to the vacuum port.

5. A road marking removal system as recited in claim 1, the nozzle further comprising at least one nozzle port, the nozzle port having a nozzle inlet orifice proximate the media inlet port and a nozzle discharge orifice, wherein a diameter of the nozzle inlet orifice is greater than a diameter of the nozzle discharge orifice.

6. A road marking removal system as recited in claim 5, the nozzle further comprising a plurality of nozzle ports, plurality of nozzle ports being arranged in a non-parallel configuration.

7. A road marking removal system as recited in claim 1, the nozzle further an articulating arrangement, allowing the nozzle to change the discharge direction during operation to increase an effective blast area.

8. A road marking removal system as recited in claim 1, further comprising a recycling arrangement, wherein the recycling arrangement comprises a filtration unit provided in combination with the vacuum unit to separate reusable material from material collected by the vacuum, wherein reusable material is transferred to the solid media hopper via a recycling conduit.

9. A road marking removal system comprising:

a carrier vehicle comprising a frame and a plurality of wheels;

a marking removal head housing having a media inlet port in fluid communication with a blasting nozzle and a vacuum particle retrieval port for extracting residual particles, the marking removal head housing being operably mounted to the carrier vehicle via at least one repositionable member, the operable mounting further comprising a slide interface rail horizontally configured and transversely mounted to a leading portion of the vehicle and a pivotal arm having the marking removal head housing assembled to a removal end of the pivotal arm and a frame mount assembled to a frame end of the pivotal arm, wherein the frame mount is slideably assembled to the slide interface rail;

an air compression unit mounted to the carrier vehicle;

a solid media hopper for injecting solid media into a media delivery conduit, the media conduit providing fluid communication between the air compressor unit and the media inlet port, the solid media hopper being mounted to the carrier vehicle;

a vacuum unit mounted to the carrier vehicle; and a vacuum conduit providing fluid communication between the vacuum particle retrieval port and the vacuum unit.

10. A road marking removal system as recited in claim 9, the marking removal head housing being shaped having an interior working area formed by a peripheral sidewall being contiguous and extending downward from a top portion.

11. A road marking removal system as recited in claim 9, the nozzle further comprising at least one nozzle port, the nozzle port having a nozzle inlet orifice proximate the media inlet port and a nozzle discharge orifice, wherein a diameter of the nozzle inlet orifice is greater than a diameter of the nozzle discharge orifice.

12. A road marking removal system as recited in claim 11, the nozzle further comprising a plurality of nozzle ports, plurality of nozzle ports being arranged in a non-parallel configuration.

13. A road marking removal system as recited in claim 9, the nozzle further an articulating arrangement, allowing the nozzle to change the discharge direction during operation to increase an effective blast area.

14. A road marking removal system as recited in claim 9, the operable mounting further comprising a pivotal arm having the marking removal head housing assembled to a removal end of the pivotal arm and a frame mount assembled to a frame end of the pivotal arm, wherein the frame mount is assembled to the carrier vehicle.

15. A road marking removal system as recited in claim 9, wherein the marking removal head housing is interchangeably assembled between each of the carrier vehicle and a manually operated removal cart assembly, the cart assembly comprising a cart frame, a plurality of wheels rotationally assembled to the cart frame, and an operator's grip.

16. A road marking removal system as recited in claim 9, further comprising a recycling arrangement, wherein the recycling arrangement comprises a filtration unit provided in combination with the vacuum unit to separate reusable material from material collected by the vacuum, wherein reusable material is transferred to the solid media hopper via a recycling conduit.

17. A road marking removal system comprising:

a carrier vehicle comprising a frame and a plurality of wheels;

a marking removal head housing having a media inlet port in fluid communication with a blasting nozzle and a vacuum particle retrieval port for extracting residual particles;

an interior working area formed within the marking removal head housing by a peripheral sidewall being contiguous and extending downward from a top portion;

an air compression unit mounted to the carrier vehicle;

a solid media hopper for injecting solid media into a media delivery conduit, the media conduit providing fluid communication between the air compressor unit and the media inlet port, the solid media hopper being mounted to the carrier vehicle;

a vacuum unit mounted to the carrier vehicle;

a vacuum conduit providing fluid communication between the vacuum particle retrieval port and the vacuum unit; and a mounting mechanism having the marking removal head housing disposed at a working end of the mounting mechanism and a vehicle mount disposed at a mounting end of the mounting mechanism, the mounting mechanism further comprising a mounting frame slide rail being transversely mounted to a leading portion of the vehicle, wherein the vehicle mount slideably engages with the mounting frame slide rail, and wherein the mounting mechanism provides lateral, longitudinal, and height movements to the marking removal head housing.

18. A road marking removal system as recited in claim 17, mounting mechanism further comprising a pivotal arm having at least one pivoting member, the pivotal arm being disposed between the marking removal head housing and the vehicle mount.

19. A road marking removal system as recited in claim 17, wherein the marking removal head housing is interchangeably assembled between each of the carrier vehicle and a manually operated removal cart assembly, the cart assembly comprising a cart frame, a plurality of wheels rotationally assembled to the cart frame, and an operator's grip.

* * * * *